US005517880A

United States Patent [19]

Schaefer

[11] Patent Number: 5,517,880

[45] Date of Patent: May 21, 1996

[54] BOTTOM DIE FOR A STAMPING TOOL FOR PRODUCING CARDBOARD BLANKS

[75] Inventor: Michael Schaefer, Eckental, Germany

[73] Assignee: Paper Converting Equipment GmbH, Neutraubling, Germany

[21] Appl. No.: 237,112

[22] Filed: May 3, 1994

[51] Int. Cl.[6] ..... B31B 1/25

[52] U.S. Cl. ..... 76/107.1; 493/471

[58] Field of Search ..... 76/107.1, 107.8, 76/DIG. 6; 493/468, 471, 60, 61, 161

[56] References Cited

U.S. PATENT DOCUMENTS

| | | | |
|---|---|---|---|
| 3,884,132 | 5/1975 | Smodgrass | 76/107.8 |
| 5,143,768 | 9/1992 | Wilderman et al. | 76/DIG. 6 |

FOREIGN PATENT DOCUMENTS

| | | |
|---|---|---|
| 0312422A1 | 9/1988 | European Pat. Off. . |
| 2639000 | 11/1988 | France . |
| 2445652A1 | 4/1975 | Germany . |
| 2546082A1 | 4/1977 | Germany . |
| 2831619A1 | 2/1980 | Germany . |

*Primary Examiner*—Douglas D. Watts
*Attorney, Agent, or Firm*—Shefte, Pinckney & Sawyer

[57] ABSTRACT

A bottom die for a stamping tool for producing cardboard blanks consists of a composite plate made from a support foil and a top layer consisting of phenol-resin bonded paper with a textile insert. Scoring grooves are milled into the top layer of phenol-resin bonded paper to serve as a counter contour of the top die of the stamping tool. The bottom die can be removably disposed on the bottom tool plate of a stamping machine by means of an adhesive layer which is self-adhesive on both sides. According to the invention, the scoring grooves are formed through the top resin bonded paper layer of the bottom die to the level of the flexible support foil, whereby the bottom die is given a relatively large degree of flexibility. Thus, a repeated use of the bottom die sheet is possible. In addition, a method for producing a bottom die for a stamping tool, employing the above-described die, is disclosed.

6 Claims, 1 Drawing Sheet

BOTTOM DIE FOR A STAMPING TOOL FOR PRODUCING CARDBOARD BLANKS

FIELD OF THE INVENTION

The present invention relates to a bottom die for a stamping tool for producing cardboard blanks. More particularly, the present invention relates to a die of the aforementioned type which can be glued to an essentially rigid stamping tool plate and which has a layer facing the top die of the stamping tool, whose surface can be milled to produce scoring grooves.

BACKGROUND OF THE INVENTION

Bottom dies for stamping tools of the type used for producing cardboard blanks are known from the prior art to consist of a phenol-resin bonded paper plate with textile inserts. These bottom dies are glued to the tool plate by means of an adhesive. In accordance with the size and shape of the stamping tool, the bottom die is provided with a reverse contour corresponding to the top die by means of a milling machine. Scoring grooves in particular are milled into the bottom die to enable folding grooves to be formed in the course of producing the cardboard blanks. In this case the accuracy of processing and the thickness of the material of the bottom die depend on the quality of the cardboard to be processed. The plate material is milled down to a remaining thickness of approximately 0.1 mm in the area of the scoring grooves. The remaining material at the bottom of the scoring grooves essentially consists of the lowermost textile insert in the die plate. The re-use of the bottom die after being applied with adhesive to the tool plate is not possible, because the die necessarily breaks when pulled off the tool plate. For this reason, it is necessary to produce fresh bottom dies for every change in cardboard stamping, which results in an increased expenditure of money and time.

SUMMARY OF THE INVENTION

It is therefore an object of the present invention to provide a bottom die which can be removed from a stamping tool plate after gluing without breaking the die so that it can be repeatedly used.

This object is attained in accordance with the present invention in that the bottom die is embodied as a composite plate, wherein the layer facing the top die is placed on a flexible support foil which can be removably glued to the tool plate and wherein the bottom of the scoring grooves milled out of the top-facing layer of the bottom die is formed by the support foil, while the lateral groove edges are formed by the top-facing layer placed on the support foil. In this manner, the flexible support foil forms movable hinges distributed over the entire bottom die sheet at the locations at which the scoring grooves are milled, by which the entire bottom die attains a very flexible structure. This flexible structure makes it possible to remove the bottom die sheet from the work plate at the completion of a stamping order to produce cardboard blanks, without breaking the top-facing layer (which was cut into individual parts by the milling process). In addition, the stamping tools and the corresponding bottom dies can now be stocked together and can be called back from inventory in the shortest possible time without it being necessary to produce a fresh bottom die. As a result, substantial savings in expenses and production time can be realized.

It is advantageous to make the support foil of polyester. These foils are especially inexpensive and therefore well-suited for the intended use.

The millable top-facing layer is preferably made of phenol-resin bonded paper plates, optimally with textile inserts, which have proven to be particularly well-suited for use in appropriate stamping machines for producing cardboard blanks.

In a preferred embodiment, the support foil and/or the tool plate can be removably connected by means of an adhesive layer which is self-adhesive on both sides. This connecting method is particularly simple and cost-effective for the intended use.

In an advantageous manner, the support foil is provided with an adhesive layer on one side, to which the millable layer is applied.

DESCRIPTION OF THE PREFERRED EMBODIMENT

Figure 1:
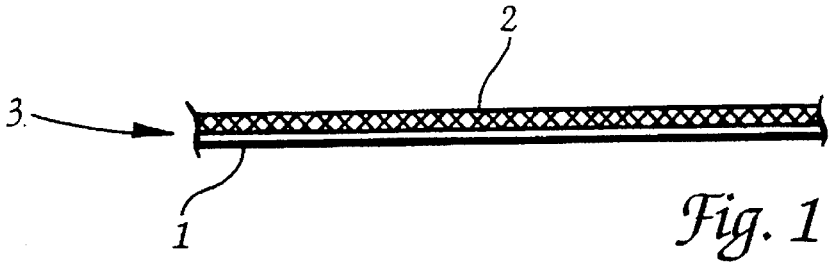
FIG. 1 is a cross-sectional view of a bottom die according to the present invention.

A composite bottom die plate according to the present invention is shown generally at 3 in FIG. 1 and consists of a support foil 1 and a millable top layer 2 preferably made of phenol-resin bonded paper with a textile insert. The flexible support foil 1 and the millable layer 2 are preferably connected with each other by an adhesive layer applied to the upper side of the support foil. The flexible support foil 1 preferably consists of polyester. The composite die plate 3 formed in this manner is used as a bottom die for a stamping tool for producing cardboard blanks.

Figure 2:
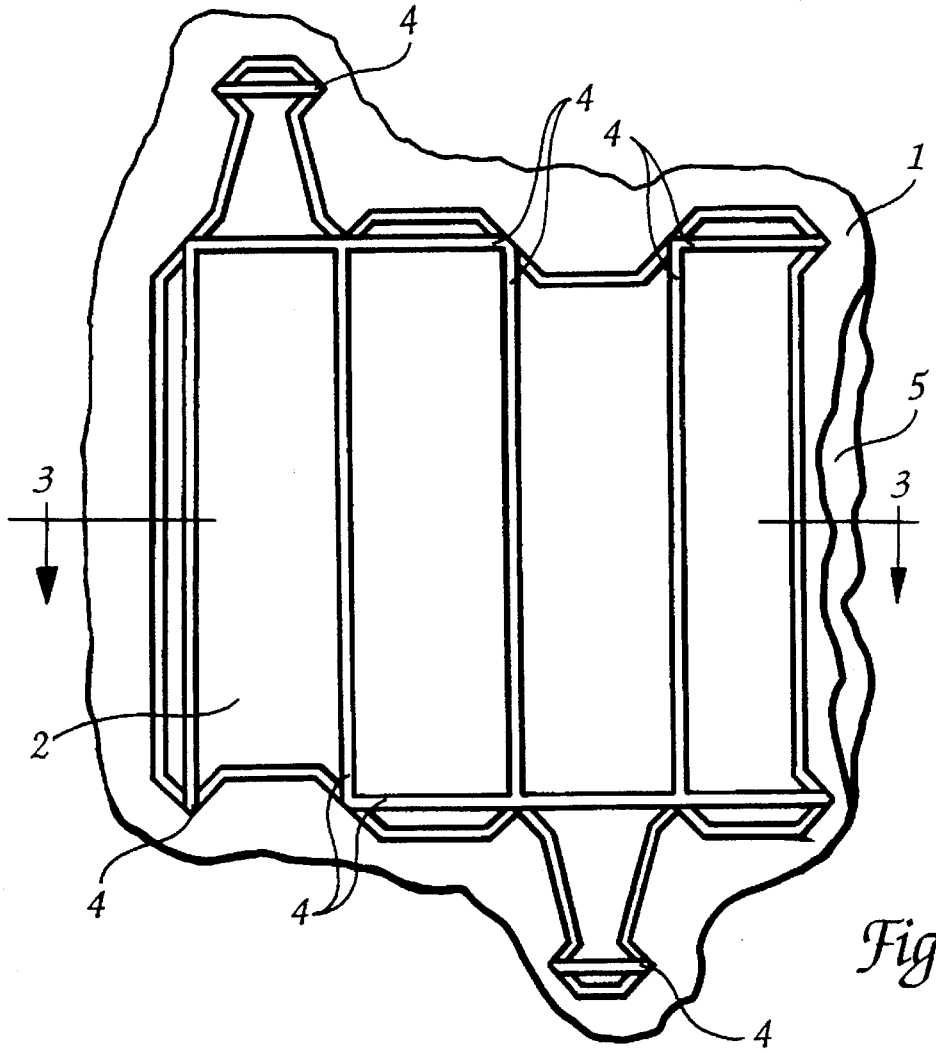
FIG. 2 is an enlarged plan view of a portion of the milled bottom die as applied to a work plate of a stamping tool.
Figure 3:
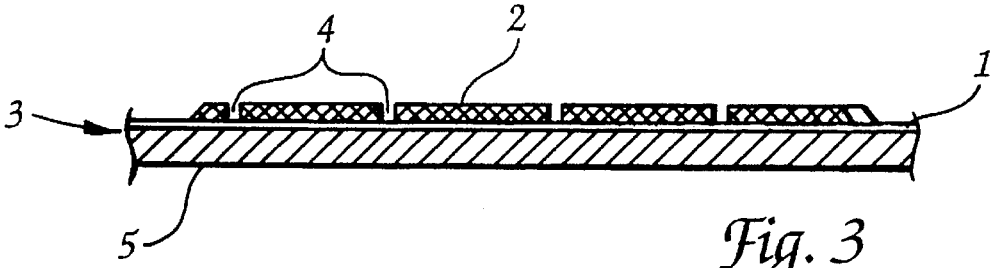
FIG. 3 is a sectional view taken along line III—III of FIG. 2.

In most cases, such a tool is a strip steel cutting tool, having top and bottom dies, the surfaces of which are covered with stamping dies and cutters. As can be seen in FIGS. 2 and 3, in order to produce a bottom die from the bottom die plate 3, it is necessary to cut out counter contours from the composite plate 3, which correspond reversely to the stamping dies or strips and the cutters on the top stamping die of the tool. For this purpose, scoring grooves 4, which correspond to the shape of the top stamping die, are milled into the top layer 2 of the composite plate 3. These scoring grooves 4 are formed to a depth in the top layer 2 to extend as far as the surface of the support foil 1. While the bottom of the scoring grooves 4 is constituted by the support foil 1, the side walls are formed by the layer 2 applied on it. At the places where the cutters of the top die are to cut subsequently through the cardboard sheet to be processed, the layer 2 is completely removed. However, the scoring grooves 4 are mainly used for creating folding grooves in cooperation with the stamping dies of the top die.

When being used in a stamping machine, the milled bottom sheet 3 is glued to a bottom tool plate 5 of the machine by means of an adhesive layer which is preferably self-adhesive on both opposite sides. The adhesive layer can be placed on the underside of the support foil 1 or on the top surface of the bottom tool plate. The adhesive layer has the property of allowing the bottom die to be easily removed subsequently from the tool plate 5. In the course of this removal process, the support foil 1 at the bottom of the scoring grooves 4 acts in the nature of hinges, the result of which is that the entire bottom die attains a comparatively large degree of flexibility. The deformation of the bottom die 3 which necessarily occurs when removing the bottom die from the tool plate 5 therefore does not need to be absorbed by the relatively brittle top layer 2, but instead is taken up essentially entirely by the support foil 1. Thus, the risk of breaking the top layer 2 of the phenol-resin bonded paper, such as is known from the prior art, is avoided with the bottom die of the present invention made from the composite plate 3.

A large reduction in costs and time is achieved by the ability of the bottom die to be stocked together with the corresponding stamping tools for subsequent repeated reuse. Thus, it is no longer necessary to produce new bottom dies when stamping orders are changed, since the bottom dies may already be completed and in stock for a repeat order.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A bottom die adapted to be glued to an essentially rigid tool plate; the bottom die comprising a composite plate having a flexible support foil adapted to be removably glued to the tool plate and a top layer on the support foil for facing a top die of the stamping tool, the top layer having a plurality of scoring grooves milled into the top layer to the level of the support foil, wherein the top layer is made of phenol-resin bonded paper plates and the phenol-resin bonded paper plates include textile inserts.

2. A bottom die in accordance with claim 1, wherein the support foil is made of polyester.

3. A bottom die in accordance with claim 1, and further comprising an adhesive layer which is self-adhesive on opposite sides for removably connecting the support foil and tire tool plate.

4. A bottom die in accordance with claim 1, wherein the support foil includes an adhesive layer on one side to which the top layer is applied.

5. A method for producing a bottom die for a stamping tool for making cardboard blanks, comprising the steps of:

a) providing a bottom die comprised of a composite plate having a flexible support foil and a top layer on the support foil, b) milling scoring grooves into the top layer of the bottom die in correspondence to a top die of the stamping tool, and forming the scoring grooves to the level of the support foil, c) adhering the bottom die to a bottom tool plate of the stamping tool with the top layer of the bottom die facing the top die, and d) removing the bottom die from the bottom tool plate subsequent to a stamping operation by using the support foil in the areas of the scoring grooves as hinges to prevent stressing and breakage of the top layer.

6. The method of claim 5, wherein the adhering step includes applying an adhesive layer which is self-adhesive on both sides to a bottom tool plate of the stamping tool or to the support foil facing away from the top layer.

* * * * *

UNITED STATES PATENT AND TRADEMARK OFFICE

CERTIFICATE OF CORRECTION

PATENT NO. : 5,517,880

DATED : May 21, 1996

INVENTOR(S) : Michael Schäfer

It is certified that error appears in the above-identified patent and that said Letters Patent is hereby corrected as shown below:

On the title page: Items [19] & [75]
The inventor's name reads "Schaefer" but should read -- Schäfer --.

Column 4, line 16, delete "tire" and insert therefor -- the --.

Signed and Sealed this

Fourth Day of March, 1997

*Attest:*

*Attesting Officer*

BRUCE LEHMAN

*Commissioner of Patents and Trademarks*